US005934235A

United States Patent [19]

Astner et al.

[11] Patent Number: 5,934,235

[45] **Date of Patent: *Aug. 10, 1999**

[54] CAMSHAFT SUPPORT ARRANGEMENT IN THE CYLINDER HEAD OF AN INTERNAL COMBUSTION ENGINE

[76] Inventors: Josef Astner, Schimmelweg 1, 70327, Stuttgart; Frank Schneider, Albstrasse 31, 73274, Notzingen; Manfred Wamser, Platanenweg 16/1, 71706, Markgröningen, all of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,029

[22] Filed: Jan. 20, 1998

[30] Foreign Application Priority Data

Jan. 21, 1997 [DE] Germany ..... 197 01 874

[51] Int. Cl.[6] ..... F01L 1/02; F02F 11/00

[52] U.S. Cl. ..... 123/90.38; 123/90.27; 123/193.3; 123/195 C

[58] Field of Search ..... 123/90.27, 90.31, 123/90.34, 90.38, 193.5, 193.3, 195 C, 198 E, 508, 509

[56] References Cited

U.S. PATENT DOCUMENTS

| | | | |
|---|---|---|---|
| 2,968,293 | 1/1961 | Kolbe | 123/90.38 |
| 5,052,351 | 10/1991 | Nishimura et al. | 123/90.27 |
| 5,215,047 | 6/1993 | Neutgens | 123/90.38 |
| 5,323,750 | 6/1994 | Rotter | 123/508 |
| 5,645,024 | 7/1997 | Allen et al. | 123/90.38 |

FOREIGN PATENT DOCUMENTS

| | | |
|---|---|---|
| 0 250 797 | 1/1988 | European Pat. Off. . |
| 0 458 341 | 11/1991 | European Pat. Off. . |
| 0 722 043 | 7/1996 | European Pat. Off. . |
| 34 24 773 | 1/1985 | Germany . |
| 36 43 438 | 10/1987 | Germany . |
| 2 140 083 | 11/1984 | United Kingdom . |

*Primary Examiner*—Weilun Lo
*Attorney, Agent, or Firm*—Klaus J. Bach

[57] ABSTRACT

In a camshaft support arrangement for supporting a camshaft in the cylinder head of an internal combustion engine by bearing structures, one end bearing adjacent one end of the cylinder head is formed integrally with a removable cover mounted onto the one end of the cylinder head.

5 Claims, 2 Drawing Sheets

CAMSHAFT SUPPORT ARRANGEMENT IN THE CYLINDER HEAD OF AN INTERNAL COMBUSTION ENGINE

BACKGROUND OF THE INVENTION

The invention relates to a camshaft bearing arrangement for supporting at least one camshaft in the cylinder head of an internal combustion engine, wherein one camshaft bearing arranged at one end of the camshaft is supported in a removable housing part of the internal combustion engine.

DE 36 43 438 C1 discloses a camshaft bearing arrangement of this type for an internal combustion engine. The camshaft of the multi-cylinder internal combustion engine is additionally supported by a bearing disposed in the timing drive cavity wall of the internal combustion engine. This bearing is supported on a bearing shield, which is bolted onto the timing drive cover. Such an arrangement, however, requires a relatively large amount of space.

For general background information further reference is made to DE 34 24 773 A1.

It is the object of the present invention to provide a camshaft bearing support arrangement in such a way that it is compact while also being sufficiently rigid.

SUMMARY OF THE INVENTION

In a camshaft support arrangement for supporting a camshaft in the cylinder head of an internal combustion engine by bearing structures, one end bearing adjacent one end of the cylinder head is formed integrally with a removable cover mounted onto the one end of the cylinder head.

An important advantage of the camshaft bearing arrangement is that, with the integration of the camshaft bearing into the removable cover of the cylinderhead of the internal combustion engine, the cylinder head can be relatively short. In addition, the support for the camshaft is relatively rigid because the camshaft bearing structure is formed integrally with the removable cover.

An embodiment of the invention with various features will be described in greater detail below on the basis of the accompanying drawings.

DESCRIPTION OF A PREFERRED EMBODIMENT

Figure 1:
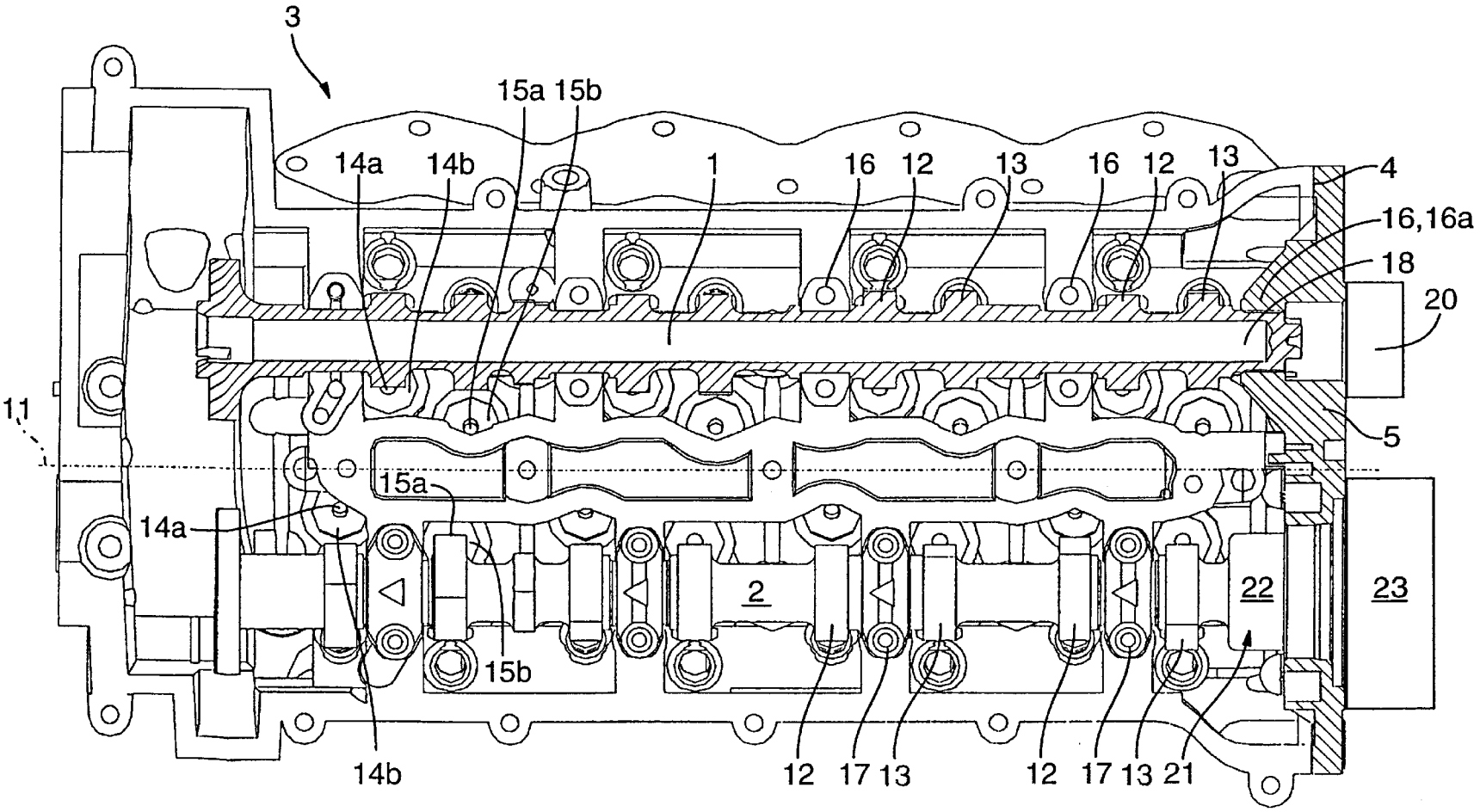
FIG. 1 is a top view of a cylinder head showing the camshaft bearing support arrangement in the cylinder head of an internal combustion engine with a removable cover mounted onto the front end of the cylinder head of the engine.

FIG. 1 shows a camshaft support arrangement for supporting an intake side camshaft 1 and an exhaust side camshaft 2 extending in the cylinder head 3 of an internal combustion engine in parallel alignment with one another. The cylinder head 3 is covered by a valve cover which is not shown in the figure.

The cylinder head 3 includes, at the front end 4 of the internal combustion engine, a removable housing part 5, which is mounted onto the engine, in the form of a cover, by screws which are not shown in the figure.

Figure 2:
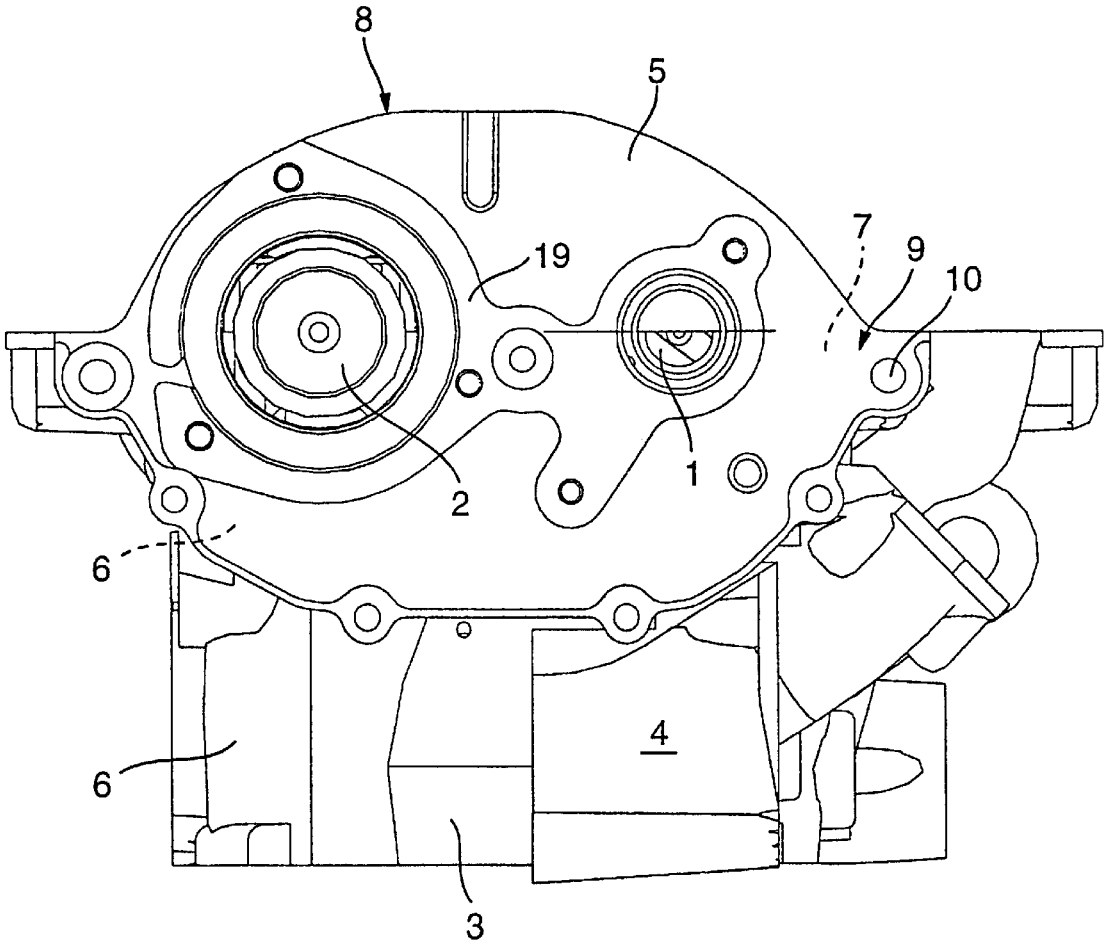
FIG. 2 is a front end view of the cylinder head showing the removable cover.

As shown in FIG. 2, the cover 5 forms a part of the front wall 6 of the cylinder head 3. The cover 5 extends up to a jointure with the valve cover of the internal combustion engine and closes a part of the timing drive space 7 of the cylinder head 3. At its upper edge, the cover 5 is provided with a sealing surface 8, which cooperates with a corresponding surface of the valve cover to provide a seal therebetween. At an intake side end 9, the cover includes a support eyelet 10 into which a load hook can be inserted for lifting the engine.

As shown in FIG. 1, each of the camshafts 1 and 2 extends parallel to the longitudinal centerline of the engine. They are provided with intake side cams 12 and exhaust side cams 13 for operating the intake valves 14 and the exhaust valves 15 of which only the valve shafts 14*a*, 15*a* with the valve spring caps 14*b*, 15*b* can be seen. The intake valves 14 and the exhaust valves 15 are tilted with respect to the longitudinal center axis 11 of the engine. On each camshaft 1, 2 the intake cams 12 and the exhaust cams 13 are arranged in an alternating fashion. The camshafts 1, 2 are rotatably supported by several camshaft bearings 16, 17 arranged in spaced relationship. In the figure, only the lower bearing parts are shown. Because of the tilted valves, the arrangement is such that for each cylinder two cams 12, 13 of the intake side camshaft 1 are disposed between two adjacent camshaft bearings 16, whereas two cams 12, 13 of the exhaust side camshaft 2 are disposed at opposite sides of a camshaft bearing 17.

In accordance with the invention, the end camshaft bearing 16*a* disposed at one end 18 of the intake-side camshaft 1 is supported in the bolted-on cover 5 which has a bearing support portion extending into the timing drive space 7 of the internal combustion engine and supports the camshaft 1 within the timing drive space 7 such that the length of the cylinder head 3 is reduced. This end camshaft bearing 16*a* is designed as an integral bearing structure. The cover 5 includes a flange area 19 (see FIG. 2) on which a pump 20 is mounted such that it is drivingly connected to the intake side camshaft 1. The pump 20 is a fuel pump for pumping fuel from the tank of the vehicle to the engine.

The exhaust side camshaft 2 has, at its end 21 adjacent the cover 5, a drive bushing 22 integrally formed with the camshaft 2 for driving a high pressure pump 23, which is also mounted in the flange area 19 of the cover 5. The high pressure pump 23 is in communication with pump 20 so as to receive fuel therefrom. The high pressure pump pressurizes the fuel sufficiently for the fuel injection system of the internal combustion engine. The camshafts 1 and 2 are sealed with respect to the cover 5 by shaft seal rings which are disposed in the cover 5, but which are not visible in the drawings. However, equipment other than pumps may be mounted on the cover 5 so as to be driven by the camshafts 1 and 2.

What is claimed is:

1. A camshaft support arrangement for supporting at least one camshaft in a timing drive space in the cylinder head of an internal combustion engine, comprising bearing structures supporting said camshaft and including, at one end of said camshaft, an end bearing, said cylinder head having a housing with opposite side walls and end walls, the end wall at said one end having a wall section omitted therefrom so as to form an opening and a separate end wall portion forming a cover mounted on said end wall in said opening, said separate end wall portion including a bearing support structure extending through said opening inwardly into said timing drive space and said end bearing being supported in said inwardly extending bearing support structure of said separate end wall portion.

2. A camshaft support arrangement according to claim 1, wherein a fuel pump is mounted on said separate end wall portion and drivingly connected to said camshaft.

3. A camshaft support arrangement according to claim 1, wherein a valve cover is disposed on top of said cylinder head and said separate end wall portion extends up to said valve cover.

4. A camshaft support arrangement according to claim 1, wherein said separate end wall portion is provided with a support eyelet for lifting said engine.

5. A camshaft support arrangement according to claim 1, wherein said camshaft has at said one end an integral drive bushing for driving a high pressure pump.

* * * * *